United States Patent [19]

Ichie et al.

[11] Patent Number: 4,882,925

[45] Date of Patent: Nov. 28, 1989

[54] METHOD OF MAKING TERMINAL NUT FOR IGNITION PLUG BY PLASTIC WORKING

[75] Inventors: Tsugumi Ichie; Minoru Ando, both of Nagoya, Japan

[73] Assignee: NGK Spark Plug Co., Ltd., Nagoya, Japan

[21] Appl. No.: 282,263

[22] Filed: Dec. 8, 1988

[30] Foreign Application Priority Data

Apr. 14, 1988 [JP] Japan ..... 63-92495

[51] Int. Cl.[4] ..... B21K 21/10

[52] U.S. Cl. ..... 72/356; 72/359; 10/27 PH

[58] Field of Search ..... 72/355, 356, 357, 340, 72/358, 359; 10/27 PH, 27 E, 12 R, 12 T, 76 R, 76 T

[56] References Cited

U.S. PATENT DOCUMENTS 3,101,534 8/1963 Lange ..... 72/356
3,186,209 6/1965 Friedman ..... 72/356
3,188,849 6/1965 Wisebaker et al. ..... 72/356
4,352,283 10/1982 Bailey ..... 72/356

FOREIGN PATENT DOCUMENTS 2141654 1/1985 United Kingdom ..... 72/356

*Primary Examiner*—Robert L. Spruill
*Attorney, Agent, or Firm*—Cooper & Dunham

[57] ABSTRACT

A method of making terminal nut for ignition plug by plastic working, comprising; first step in which a metallic blank is struck at its end surfaces to flatten the end surfaces in perpendicular to axial direction of the blank; second step in which a central conical dent is formed at one end surface of the blank, and forming first bottom-ended hole at other end surface of the blank; third step in which second bottom-ended hole is formed concentrically and continuously from the first bottom-ended hole at the blank to be diametrically lesser than the first bottom-ended hole; fourth step in which the blank is axially contracted to diametrically bulge outward by upsetting; fifth step in which a perforation hole is axially formed at the blank by punching in concentrical relationship with the first bottom-ended hole; sixth step in which the blank is shaved at its bulged portion.

9 Claims, 4 Drawing Sheets

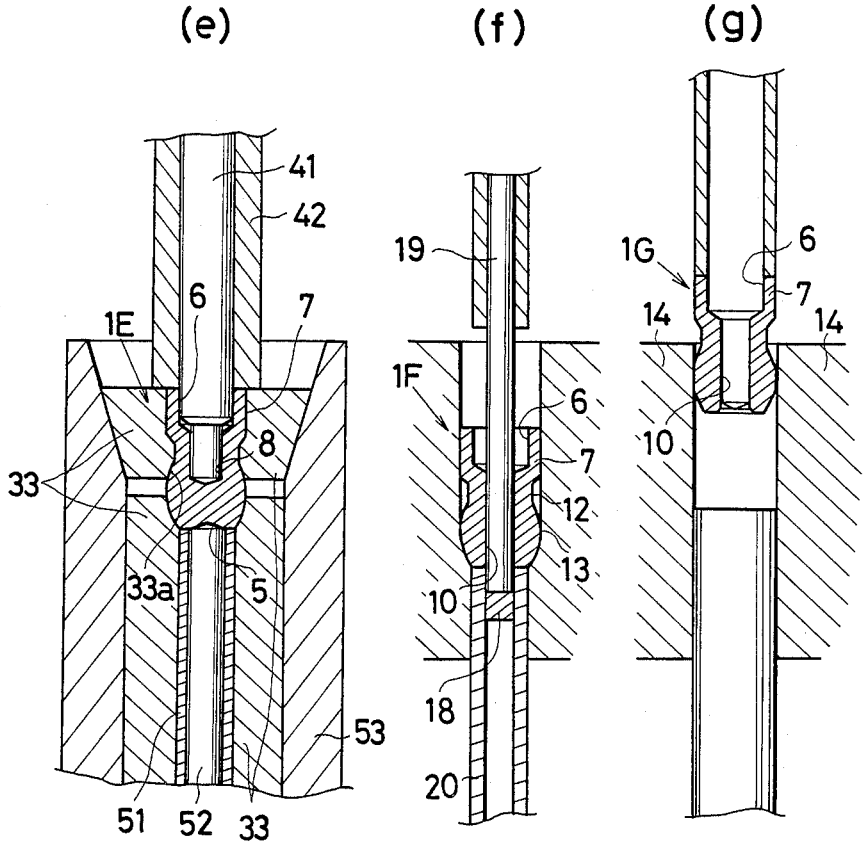
(e)
(f)
(g)
41
42
6
7
1E
8
33
33a
5
53
51
52
33
19
1F
6
7
12
13
10
18
20
1G
6
7
14
14
10

METHOD OF MAKING TERMINAL NUT FOR IGNITION PLUG BY PLASTIC WORKING

A method of making terminal nut for ignition plug by plastic working

BACKGROUND OF THE INVENTION

1. Field of the Invention

This invention relates to a method of making terminal nut for ignition plug by plastic working.

2. Description of the Prior Art

In an ignition plug in use for an internal combustion engine, there is provided a housing which includes an outer shell to facilitate mounting a plug body on a cylinder head. The housing encloses an insulator made from high purity alumina porcelain, for example, and an center and ground electrode to cause a discharge therebetween.

A terminal nut is capped on the top of the plug body to connect a high voltage cord to the center electrode.

This kind of the terminal nut has been usually made by cutting a metallic blank, otherwise by molding soft metals such as zinc and aluminium-based alloy by means of die casting.

The cutting method, however, produces waste chips, the quantity of which reaches as far as one-half volume of whole the blank so as to result in loss of material.

Further, the cutting method is time-consuming to reduce productivity. The die casting method invariably accompanies with dust, high temperature, considerable level of noise, and toxic gas by subjecting mold-removing agent to heated mold blocks. Thus presenting an adverse working condition, and having a risk to harmfully influence on health.

In addition, material of the blank available to the die casting method, is generally confined to only parts of soft metals such as zinc and aluminium-based alloy. Selection range of the blank materials is limited, and making it difficult to obtain sufficient hardness as a final product.

Therefore, it is an object of this invention to provide a method of making terminal nut which is capable of reducing a time required to be manufactured for an improved productivity with less cost.

According to this invention, there is provided a method of making a terminal nut comprising; first step in which a column-shaped metallic blank is set into a cylindrical die, and struck at both end surfaces to flatten the end surfaces in perpendicular to axial direction of said blank by means of plungers; second step in which a punching rod is forcibly caved into one end surface of said blank with other end surface of said blank supported by a conical headed mandrel to form a central conical dent at one end surface of said blank, and at the same time, forming first bottom-ended hole at other end surface of said blank; third step in which a punch rod is forcibly caved into said first bottom-ended hole to form second bottom-ended hole at said blank by means of reducing concentrically and continuously from said first bottom-ended hole to be diametrically lesser than said first bottom-ended hole; fourth step in which said blank is enclosed into a cylindrical die having a constricted inner wall to be axially contracted to bulge a side surface of said blank diametrically outward by means of upsetting; fifth step in which a perforation hole is axially formed at said blank by punching in concentrical relationship with said first bottom-ended hole, said perforation hole being diametrically corresponding to said second bottom-ended hole; sixth step in which said blank is shaved at its bulged portion with the use of a cylindrical die means.

These and other aspects of the invention are more described in the following specification and drawings.

BRIEF DESPECTION OF THE DRAWINGS

DESCRIPTION OF PREFERRED EMBODIMENT

In reference with the accompanied drawings, a preferred embodiment of this invention is described hereinafter.

Figure 1:
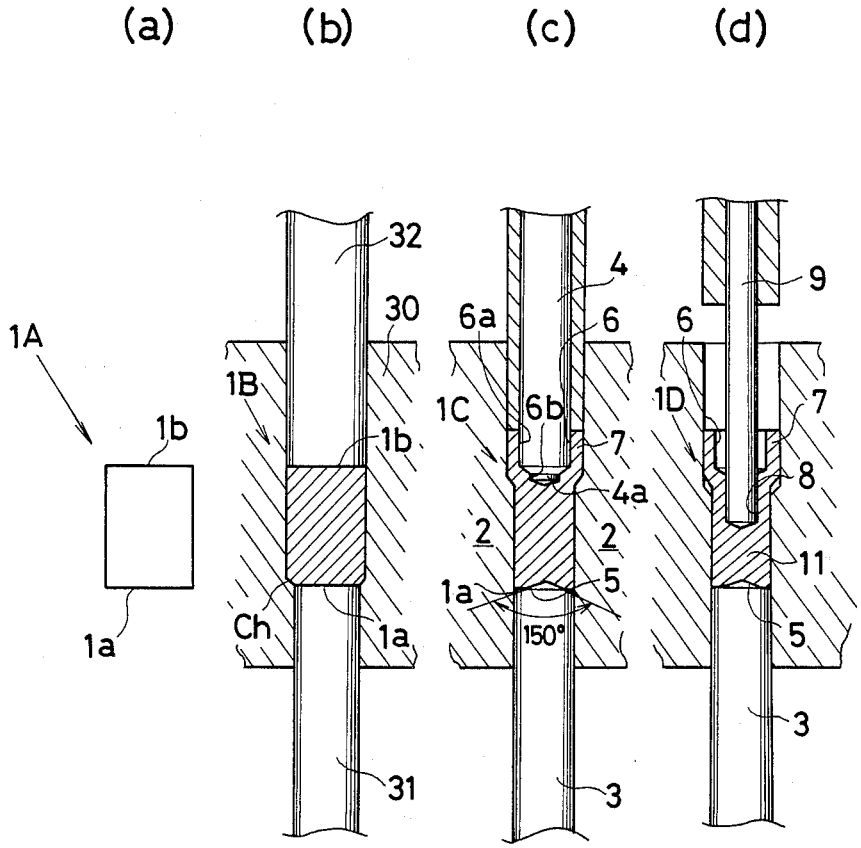
FIG. 1 is a schematic view for the purpose of elucidating steps of making a terminal nut.
Figure 3:
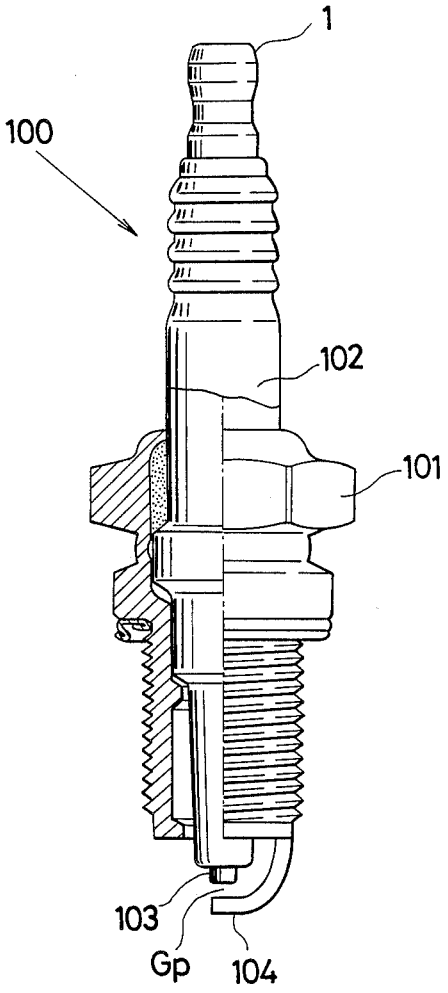
FIG. 3 is a plan view of an ignition plug, but partly sectioned.

Steps during a terminal nut 1 is seqentially made, is shown in FIG. 1. Prior to elucidating the steps of FIG. 1, attention is called to FIG. 3 of an ignition plug 100, on which the nut 1 is to be mounted. The plug 100 is in use for an internal combustion engine, and there is provided a housing 101 which includes an outer shell to facilitate mounting the plug 100 on a cylinder (not shown) head.

The housing 101 encloses an insulator 102 made from high purity alumina porcelain, for example, and having a center electrode 103 and a ground electrode 104 which causes a discharge therebetween (designated by Gp). The terminal nut 1 is to be capped on the top of the plug 100 to connect a high voltage cord (not shown) to the center electrode 103.

Returning back to FIG. 1, a column-shaped blank 1A made from aiuminium or ferro-based metal, is severed at the determined dimension such as, for example, 6.0mm in diameter, 7.5 mm in length as seen at (a). In subsequent to this severing process, the blank 1A is placed into a cylindrical die 30, and struck at both end surface 1*a*, 1*b* by plungers 31, 32 to be flat in perpendicular to the axial direction of the blank 1A at first step (b). At this step (b), the blank 1A is simultaneously bevelled at a periphery of the end surface 1a as designated by (Ch) to precisely treat subsequent steps. The blank treated at the first step (b), is newly called as blank 1B. The blank 1B is restricted at its position by an apapropriately defined cylindrical die 2 at second step (c).

In this step (c), the blank 1B is supported at a center of its end surface 1a on a conical headed mandrel 3, an apex of which has an angle of 150 degrees, for example.

Into a center of the end surface 1b of the blank 1B, a punch 4 is forcibly caved which has a diameter smaller than that of the blank 1B. In this process, a conical dent (dimple) 5 is formed at the end surface 1a, an apex of which has an obtuse angle, and first bottom-ended hole 6 is formed at the end surface 1b by means of reducing.

The blank treated at the second step (c) is designated as 1C. With the formation of the first bottom-ended hole 6, the blank 1C is diametrically bulged outward to define a cylindrical portion 7 as a result of reduction according to the second step (c).

At third step (d), second bottom-ended hole 8 is formed at the blank 1C to be somewhat smaller than the first bottom-ended hole 6 in diameter. The second bottom-ended hole 8 is in concentrical and continuous relationship with the first bottom-ended hole 6. This step (d) is performed with the use of a punch rod 9 which is forcibly caved into the hole 6 and having a dimension smaller in diameter, but greater in length than the punch 4. The blank treated through the third step (d), is designated by 1D. The punch 4 used in the third step (d) has a diameter-reduced lower end 4a to form a recess 6b which serves as a positioner when forming the second bottom-ended hole 8. The recess 6b accompanies with an inner surface 6a of the first bottom-ended hole 6 to appear a step-like configuration as a whole. In this instance, it is determined that the recess 6b remains at its lower end substantially the same level as that of the cylindrical portion 7, and does not extend the lower end deeper than that of the cylindrical portion 7. The punch 3 is adapted to tightly engage with the end surface 1a of the blank 1C so as to prevent cracks from occurring at the blank 1C as described hereinafter by referring to FIGS. 4 and 5.

The conical dent 5 of the end surface 1a acts to help form a perforation hole 10 in concentrical relationship with the blank 1C more precisely as described hereinafter.

With the conical dent 5 having its apex angle as obtuse, a tendency that cracks occur at the blank during plastic working is minimized.

The blank 1D treated through the third step (d), is placed into a divided cylindrical die 33 having a constricted inner wall 33a, and axially contracted and diametrically bulged outward simultaneously by means of upsetting at fourth step as seen at (e) of FIG. 1. The blank treated through the fourth step (e) is with the use of plastic forming machine (not shown). The machine comprising a punch-driving portion and a support portion (not shown). The punch-driving portion has a guide pin 41 for positioning the blank 1D and, a tubular punch rod 42 into which the pin 41 is placed.

In addition, a pickup sleeve 51 is placed inside the cylindrical die 33 to enclose a mandrel 52. Outside the die 33, is a support 53 placed in a manner to surround the die 33.

The blank treated through the fourth step (e) is designated by denotation 1E, and moved to fifth step (f). At this step (f), the perforation hole 10 is axially formed at a solid portion 11 of the blank in concentrical relationship with the first and second bottom-ended holes 6 and 8 by means of a punching rod 19 to deform into the blank 1F. A waste chip 18 coming from the punching process (f), is adapted to pass through a hollow portion of a cylindrical mandrel 20 for the purpose of disposal.

Particularly in this situation, the perforation hole 10 has a diameter identical to that of the second bottom-ended hole 8. Thus the blank 1F becomes in the form of tubular shape with a neck portion 12 between a bulged portion 13 and the cylindrical portion 7.

Figure 2:
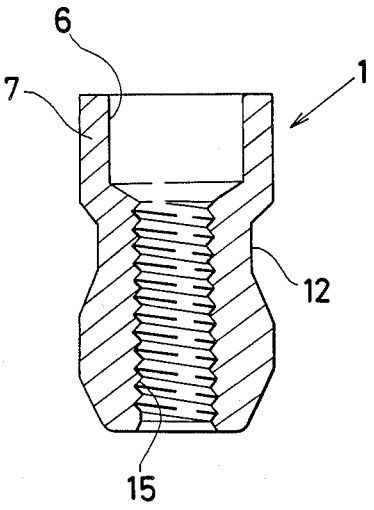
FIG. 2 is a cross sectional view of a finished nut.

It is conceived that prior to the upsetting process, the perforation hole 10 may be performed. This instance, however, causes to unfavorably enlarge the diameter of the perforation hole 10 during the upsetting process. Posterior to the fifth step (f), the blank 1F is moved to sixth step (g) in which the blank is shaved at its bulged surface 13 into which a cap (not shown) of the high voltage cord fits both snugly and positively. The blank by the step (g) is treated by means of a cylindrical die 14, and designated by 1G which has a dimension of approximately 6.45 mm in diameter, and approximately 10 mm in length. In the subsequent step, a thread 15 is formed at an inner wall of the perforation hole 10 to make a final product of the terminal nut 1 as shown in FIG. 2. The nut 1 is capped to a top terminal end of the ignition plug 100 for the connection of the high voltage cord.

In general, a metallic blank as employed in this embodiment has a tendency that cracks often occur during plastic working proces. This is particularly true at the step of performing the upsetting as well as forming the first bottom-ended hole 6, and providing the conical dent 5 with the end surface 1a.

To cope with this unavoidable tendency, the recess 6b is determined at its lower end to be equal level to that of the cylindrical portion 7.

Further, the apex angle of the conical dent 5 is determind to be obtuse (150 degrees) according to this embodiment.

As a result, all the steps according to this embodiment is sufficiently capable of preventing cracks from occurring at the blank during plastic working.

Figure 4:
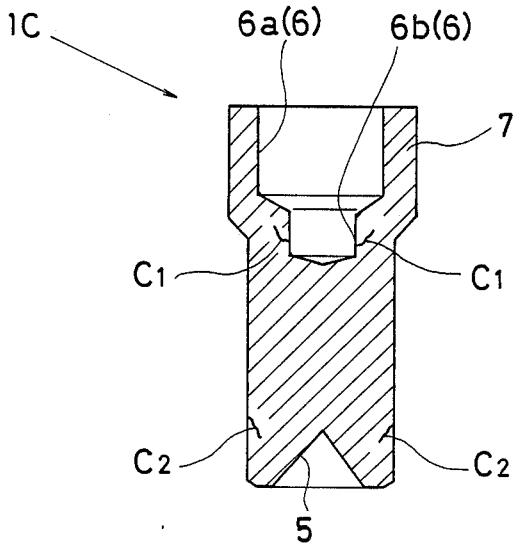
FIGS. 4 and 5 are views of a nut to indicate parts in which cracks often occurs.

Attention is called to FIG. 4 in which crack-occurring portions are shown by C1 when the recess 6b is determined at its lower end to extend deeper beyond that of the cylindrical portion 7. This means that the recess 6b is terminated at its lower end, at a portion in which the blank is reduced at the second step (c). Attention is called to FIG. 5 in which crack-occurring portions are shown by C2 when the apex angle of the conical dent 5 is determind to be acute (e.g. 80 degrees).

Figure 5:
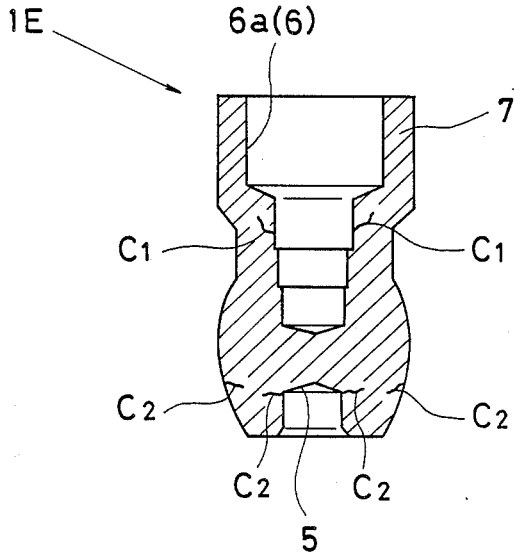

In FIGS. 4 and 5, the reference numerals corresponding to the identical members of FIG. 1 is used for the sake of convenience.

As understood from the foregoing description, the steps according to this invention, obviously enables to reduce the time interval required, in comparison to the cutting and die casting method. Waste chips appeared at the step of forming the perforation hole 10, are kept its quantity at minimum. Thus reducing loss of material to a significant degree, and minimizing manufacturing cost.

Further, all the steps according to this invention does not accompany with high temperature atmosphere, dust and toxic gas, thus preventing from having adversely influence on health.

In addition, inexpensive but hard ferro-based metal can be employed, in opposition to the prior die casting method.

Even when the soft metal such as zinc and aluminiumbased alloy is used, the blank is eventually forged during plastic working. Sufficient hardness is imparted with the final product of the terminal nut, so that the nut does not wear loose enough to electrically contact, however often the cap of the high voltage cord is repeatedly put on and taken out.

Although, the preferred embodiment of this invention has been shown and described, it should be understood that various modifications and rearrangements of the parts may be restored to without departing from the scope of the invention as disclosed and claimed herein.

What is claimed is:

1. A method of making terminal nut for ignition plug by plastic working, comprising;

first step in which a column-shaped metallic blank is set into a cylindrical die, and struck at both end surfaces by plungers to flatten the end surfaces in perpendicular to axial direction of said blank;

second step in which a punch rod is forcibly caved into one end surface of said blank with other end surface supported by a conical headed mandrel in order to form a central conical dent at one end surface of said blank, and at the same time, forming first bottom-ended hole at other end surface of said blank by means of reducing;

third step in which a punch rod is forcibly caved into said first bottom-ended hole to form second bottom-ended hole at said blank concentrically and continuously from said first bottom-ended hole to be diametrically lesser than said first bottom-ended hole;

fourth step in which said blank is enclosed into a cylindrical die having a constricted inner wall, and axially contracted to bulge a side surface of said blank diametrically outward by means of upsetting;

fifth step in which a perforation hole is axially formed at said blank by a punching means in concentrical relationship with said first bottom-ended hole, said perforation hole being diametrically corresponding to said second bottom-ended hole;

sixth step in which said blank is shaved at its bulged portion with the use of a cylindrical die means.

2. A method of making terminal nut for ignition plug by plastic working as recited in claim 1, said blank is bevelled at periphery of one end surface opposite to that said bottom-ended hole has formed.

3. A method of making terminal nut for ignition plug by plastic working as recited in claim 2, said blank is bevelled at least simultaneously at said first step.

4. A method of making terminal nut for ignition plug by plastic working as recited in claim 1, said conical dent formed by said second step has an obtuse angle at its apex.

5. A method of making terminal nut for ignition plug by plastic working as recited in claim 4, said conical dent formed by said second step has an angle of 150 degrees at its apex.

6. A method of making terminal nut for ignition plug by plastic working as recited in claim 1, a diameter-reduced recess terminating its lower end, at most, at a portion in which the blank is reduced at said second step.

7. A method of making terminal nut for ignition plug by plastic working as recited in claim 1, a waste chip appeared by punching said blank to form said perforation hole, and adapted to pass through a cylindrical mandrel for the purpose of disposal.

8. A method of making terminal nut for ignition plug by plastic working as recited in claim 1, said diameter-reduced recess is formed at said blank simultaneously at the second step, said recess being in concentrical and continuous relationship with said first bottom-ended hole, and serving as a positioner of the punch rod used at the subsequent step.

9. A method of making terminal nut for ignition plug by plastic working as recited in claim 8, said recess extending its lower end to be, at most, length equal to that of a cylindrical portion.

* * * * *